US006979107B1

(12) United States Patent
Benensohn

(10) Patent No.: US 6,979,107 B1
(45) Date of Patent: Dec. 27, 2005

(54) PUCK LIGHTING FIXTURE

(75) Inventor: Sanford H. Benensohn, Beverly Hills, CA (US)

(73) Assignee: Lusa Lighting, Inc., Valencia, CA (US)

( * ) Notice: Subject to any disclaimer, the term of this patent is extended or adjusted under 35 U.S.C. 154(b) by 0 days.

(21) Appl. No.: 10/640,292

(22) Filed: Aug. 13, 2003

(51) Int. Cl.[7] ..... F21V 21/00

(52) U.S. Cl. ..... 362/374; 362/133; 362/147; 362/294; 362/345; 362/368; 362/373; 362/375

(58) Field of Search ..... 362/127, 133–134, 362/147, 154–155, 173, 441, 294, 345, 368, 362/373–375

(56) References Cited

U.S. PATENT DOCUMENTS

| | | | | | |
|---|---|---|---|---|---|
| 2,494,428 | A | * | 1/1950 | Buck | 439/351 |
| 3,115,308 | A | * | 12/1963 | Stark | 362/311 |
| 3,229,939 | A | * | 1/1966 | Hubbard | 248/27.1 |
| 3,652,847 | A | * | 3/1972 | McFarlin | 362/277 |
| 3,660,651 | A | * | 5/1972 | Miles, Jr. | 362/366 |
| 3,683,173 | A | * | 8/1972 | Guth, Jr. | 362/366 |
| 3,721,817 | A | * | 3/1973 | Contratto | 362/365 |
| 3,962,675 | A | * | 6/1976 | Rowley et al. | 362/101 |
| 4,086,483 | A | * | 4/1978 | Freund et al. | 362/311 |
| 4,175,282 | A | * | 11/1979 | Grindle et al. | 362/363 |
| 4,302,798 | A | * | 11/1981 | Sit | 362/147 |
| 4,313,153 | A | * | 1/1982 | Davis | 362/184 |
| 4,320,949 | A | * | 3/1982 | Pagano | 396/427 |
| 4,507,719 | A | * | 3/1985 | Quiogue | 362/404 |
| 4,514,792 | A | * | 4/1985 | Klaus | 362/294 |
| 4,754,383 | A | * | 6/1988 | Klaus | 362/363 |
| 4,862,334 | A | * | 8/1989 | Ivey et al. | 362/149 |
| 5,045,978 | A | * | 9/1991 | Gargle | 362/101 |
| 5,097,400 | A | | 3/1992 | Cvek | 362/345 |
| 5,394,316 | A | | 2/1995 | Holbrook et al. | 362/294 |
| 5,400,231 | A | | 3/1995 | Huang | 362/294 |
| 5,467,259 | A | * | 11/1995 | Hume et al. | 362/307 |
| 5,738,437 | A | * | 4/1998 | Ilagan | 362/363 |
| 5,909,955 | A | * | 6/1999 | Roorda | 362/368 |
| 5,931,567 | A | * | 8/1999 | Salzmann et al. | 362/304 |
| 5,971,558 | A | * | 10/1999 | Peel | 362/26 |
| 6,042,251 | A | * | 3/2000 | McCarthy et al. | 362/308 |
| 6,050,708 | A | * | 4/2000 | Roorda | 362/375 |
| 6,082,878 | A | * | 7/2000 | Doubek et al. | 362/365 |
| 6,116,758 | A | * | 9/2000 | Lin | 362/364 |
| 6,132,069 | A | * | 10/2000 | Sato et al. | 362/365 |
| 6,250,781 | B1 | * | 6/2001 | Straus et al. | 362/375 |
| 6,302,569 | B1 | * | 10/2001 | Huang | 362/546 |
| 6,350,043 | B1 | * | 2/2002 | Gloisten | 362/287 |

(Continued)

OTHER PUBLICATIONS

Evolution Minilites Collection brochure, 1900 N. Andrews Ave. Ext., Suite C, Pompano Beach, FL 33069 (undated).

(Continued)

*Primary Examiner*—Stephen Husar
*Assistant Examiner*—Jason Han
(74) *Attorney, Agent, or Firm*—Baker, Donelson, Bearman, Caldwell & Berkowitz

(57) ABSTRACT

A lighting fixture having a housing with a base and an opposing openable end, and a flange spaced-apart from an edge at the openable end that extends radially from an exterior surface of the housing. A reflector defines a dished cavity and seats on the edge of the housing, thereby defining a recess between an edge portion of the reflector and the flange. A light source is received within the housing. A light transmissive cover received on the housing has a tab received in the recess for guiding the rotation of the cover thereon.

29 Claims, 3 Drawing Sheets

U.S. PATENT DOCUMENTS

| | | | | |
|---|---|---|---|---|
| 6,431,722 | B1 * | 8/2002 | Benensohn | 362/133 |
| 6,457,848 | B1 * | 10/2002 | Wolf et al. | 362/364 |
| 6,474,846 | B1 * | 11/2002 | Kelmelis et al. | 362/365 |
| 6,491,413 | B1 * | 12/2002 | Benesohn | 362/294 |
| 6,585,389 | B2 * | 7/2003 | Bonazzi | 362/147 |
| 6,622,537 | B2 * | 9/2003 | Rodriguez | 70/432 |
| 6,669,355 | B2 * | 12/2003 | Layne et al. | 362/294 |
| 6,755,559 | B2 * | 6/2004 | Wang et al. | 362/368 |
| 6,814,462 | B1 * | 11/2004 | Fiene | 362/133 |
| 2003/0151925 | A1 * | 8/2003 | Crunk | 362/545 |
| 2004/0001336 | A1 * | 1/2004 | Wang et al. | 362/147 |
| 2004/0017681 | A1 * | 1/2004 | Lee | 362/133 |

OTHER PUBLICATIONS

Outwater Hardware Catalog, pp. 154, 155; Outwater Hardware Corporation, 11 West End Road, Totowa, NJ 07512 (1998).

Laura & Honnelore Co., Ltd. flyer in GES Lighting Review Catalog, Oct. 1998.

Home Lighting and Accessories, Disc Light, Apr. 1996, p. 133.

Lighting Concepts, Outwater Plastic Industries, Inc., 4 Passaic Street, PO Drawer 403, Wood-Ridge, NJ 07075 (undated).

* cited by examiner

PUCK LIGHTING FIXTURE

TECHNICAL FIELD

The present invention relates to under-cabinet lighting fixtures. More particularly, the present invention relates to puck-type under-cabinet lighting fixtures which are readily installed with a cap to provide lighting from mounting surfaces.

BACKGROUND OF THE INVENTION

Lights and lighting provide useful general illumination of interior and exterior spaces in homes and buildings, as well as ornamental and artistic treatments for decorative purposes. These purposes include lighting functions for accent and interior ornamental design functions, highlights for artwork, illuminating work areas, and other functions. Often furniture or cabinetry have lights for illuminating articles held within the furniture or cabinets. For cabinets, and in particular kitchen wall cabinets, lighting fixtures are often mounted to a lower exterior surface or recessed therein, for illuminating countertop surfaces below the cabinets.

One type of lighting fixture is known as an under-cabinet puck light. These lights have generally cylindrical disc-shaped housings. The housings contain a reflector, a lamp socket with a light emitting bulb, and a glass lens for transmitting light from the housing to the countertop surface below the cabinet. The socket connects to a supply of electrical current. The lights provide pools of lights to the countertop surface, and are used typically in kitchens and display cabinetry for providing light on the working surfaces in kitchens as well as for use in highlighting articles in display cabinets. Under-cabinet puck lights that are commercially available operate with 12 volt direct current, or more recently, as disclosed in my U.S. Pat. No. 6,491,413, operate on 120 volt (line) alternating current. Generally, the puck-type lighting fixtures are provided commercially as after-market installation devices.

My U.S. Pat. No. 6,491,413 discloses an improved line voltage puck lighting fixture. The lighting fixture provides an under-cabinet lighting fixture for surface and recessed mounting and operating on high line voltage for increased illumination with controlled transfer of the heat communicated from the fixture, with a housing that defines an open end opposing a base having a thickened portion. The housing defines a plurality of openings in the base, and a plurality of projections extending from an edge of the housing. A reflector defining a dished cavity seats on the projections to define a gap between the reflector and the housing. A lamp socket received in the housing engages a lamp bulb that is substantially in alignment with the thickened portion of the base and disposed in the dished cavity. A cap received on the housing has a plurality of spaced-apart ports. The high voltage lighting fixture defines a pathway for communicating air through the ports, the gap, and the openings, past the reflector for communicating heat from the reflector to ambient air.

The lighting fixture of this type works well for line voltage applications, however, there are other drawbacks experienced during use. For instance, the screws connecting the reflector to the base tend occasionally to reduce the gap between the reflector flange and the edge of the base. This made it more difficult to install the cap. Also, metal screws tended to transmit heat from the reflector to the base, rather than allowing heat to flow away from the base through the vents.

Accordingly, there is a need in the art for an improved under-cabinet lighting fixture for surface and recessed mounting installed with a cap that easily connects to the reflector and base and that better allows heat to flow away from the base through the vents to the ambient air. It is to such that the present invention is directed.

BRIEF SUMMARY OF THE PRESENT INVENTION

The present invention provides an under-cabinet lighting fixture having a housing with a base and an opposing openable end, and a flange spaced-apart from an edge at the openable end that extends radially from an exterior surface of the housing. A reflector defines a dished cavity and seats on the edge of the housing, thereby defining a recess between an edge portion of the reflector and the flange. A light source is received within the housing. A light transmissive cover received on the housing has a tab received in the recess for guiding the rotation of the cover thereon.

Objects, advantages, and features of the invention will be come apparent upon a reading of the following detailed description of the present invention in conjunction with the drawings and the appended claims.

DETAILED DESCRIPTION

Figure 1:
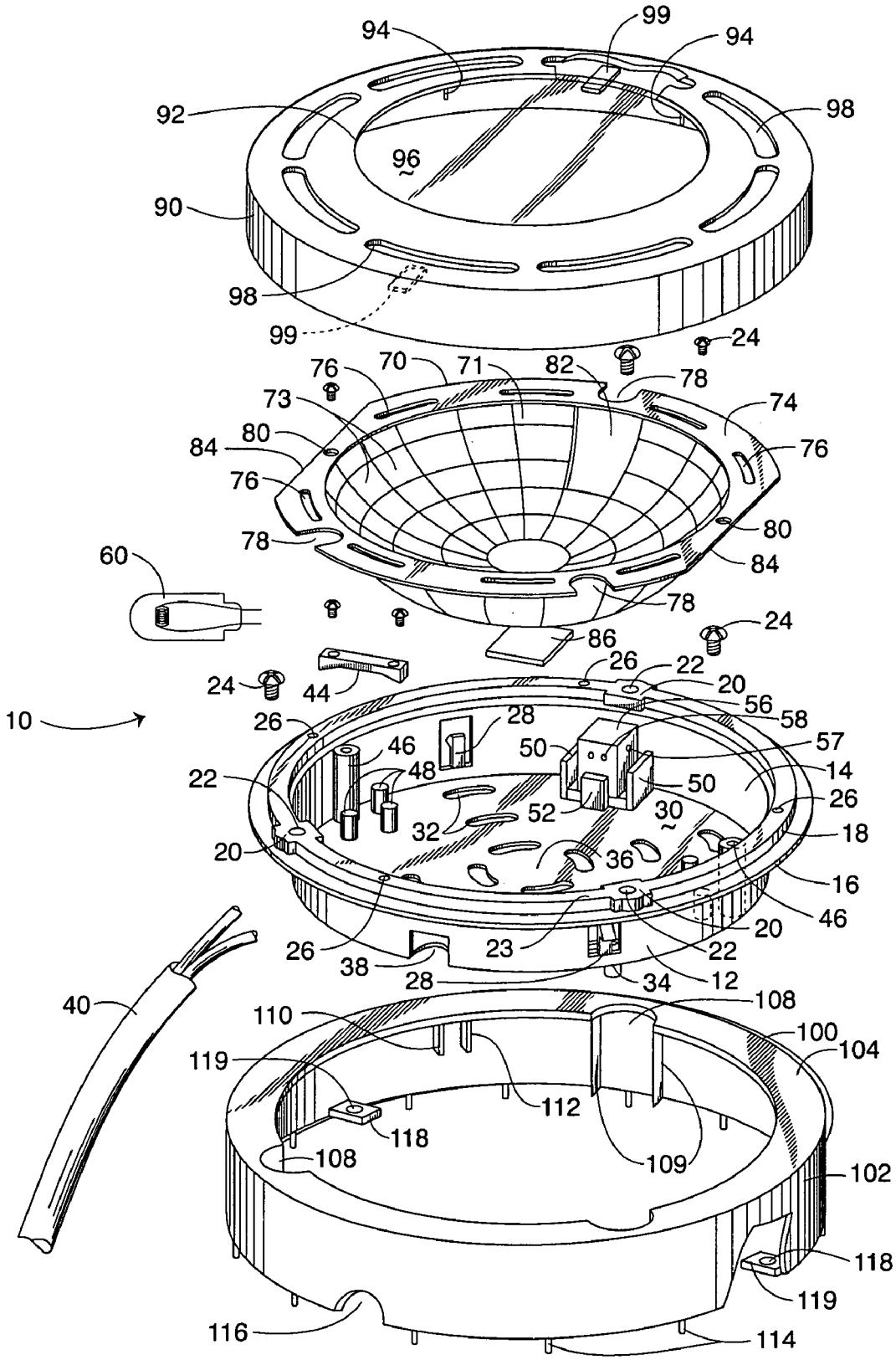
FIG. 1 is an exploded perspective view of a light fixture according to the present invention.
Figure 4:
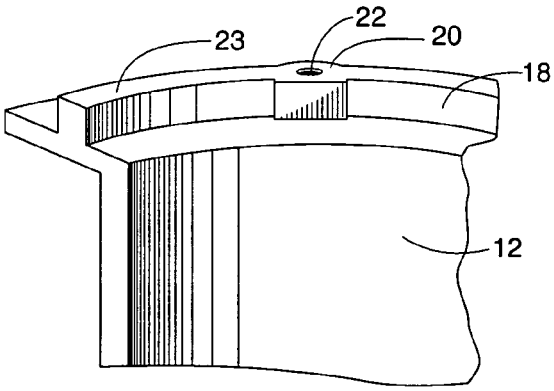
FIG. 4 is a perspective view illustrating details of a portion of the housing of the light fixture shown in FIG. 1.

Referring now in more detail to the drawings in which like parts have like identifiers, FIG. 1 illustrates in exploded perspective view a light fixture 10 according to the present invention. The light fixture 10 readily mounts as an under-cabinet lighting fixture or recessed mounting, as discussed below. The light fixture 10 comprises a housing 12 having an open end 14 with a flange 16 extending laterally therefrom. The flange 16 is spaced-apart from an edge of the housing at the open end. As a result, a ridge or wall 18 extends around the edge from a first surface of the flange 16 longitudinally relative to the housing 12. The wall 18 defines thickened portions 20 that each defines a hole 22. As best illustrated in FIG. 4, each hole 22 is recessed so that a threaded screw 24 received in the hole 22 sits flush with a distal surface 23 of the wall 18. Four stops 26 extend laterally from a outward side of the wall 18. A pair of opposing tabs 28 are defined in a side wall of the housing 12. The tabs 28 extend at a first end from the side wall for flexible movement relative to the housing 12, for a purpose discussed below. The tabs 28 include an outwardly extending tip.

Figure 2:
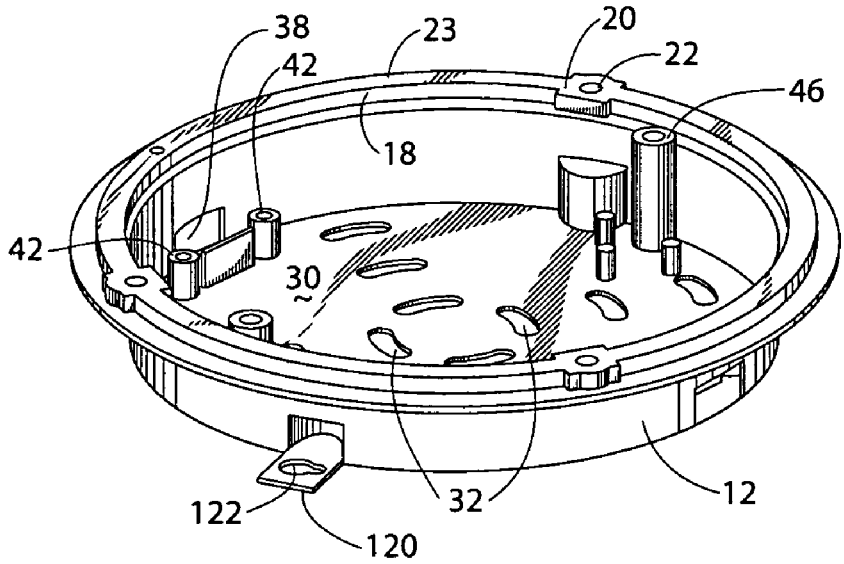
FIG. 2 is a perspective top view of an alternate embodiment of the housing for the light fixture shown in FIG. 1.
Figure 3:
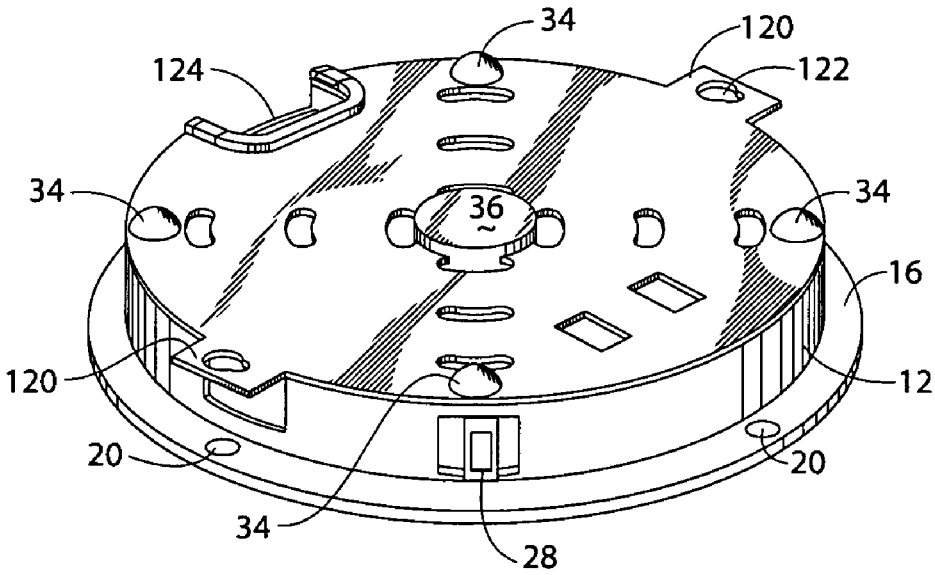
FIG. 3 is a perspective bottom view of the housing illustrated in FIG. 2.

The housing 12 defines a partially closed bottom 30 having a plurality of openings 32. In the illustrated embodiment, the openings 32 are aligned slots defining concentric rings arranged radially. Four semisperical legs 34 extend from an outer surface of the bottom 30. A central portion 36 defines a thickened portion of the bottom 30, as best illustrated in FIG. 3. In the illustrated embodiment, the thickened portion 36 extends slightly from an exterior surface of the bottom, or about 0.06 inches from the surface of the bottom 30, to approximately double the thickness of the wall of the housing 12 in the central portion 36. The side wall of the housing defines a slot 38 adjacent the bottom 30 for receiving a pair of electric wires 40. A pair of lugs 42 extend upwardly from opposing sides of the slot 38 as illustrated in FIG. 2. A U-shaped brace 44 defines a pair of opposing holes at distal ends. The brace 44 connects to the lugs 42 with screws entering the lugs 42 through the holes for securing the electrical wires 40 in the slot 38. A pair of posts 46 extend between the open end 14 and the bottom 30 on opposing sides of the housing 12. The posts 46 each define a longitudinal bore. Studs 48 extend from the bottom 30 and are spaced-apart from each of the respective posts 46.

A pair of tabs 50 extend upwardly from the bottom 30. Each tab 50 defines an angled hook at a distal end. A plate 52 extends upwardly from the bottom 30 radially inwardly from the side wall of the housing and between the tabs 50. The tabs 50, the plate 52, and a portion of the wall of the housing 12 cooperatively define a recess that receives a lamp socket 56. The lamp socket 56 defines opposing openings 57 for receiving the ends of the electrical wires 40 and lamp post sockets or openings 58 for engaging pins of a lamp or light bulb 60.

The lighting fixture 10 includes a reflector 70. The reflector 70 defines a dish-shaped cavity 71 with a laterally extending flange 74. The face of the dish-shaped cavity 71 defines a plurality of facets 73 for reflecting light. The flange 74 defines a plurality of spaced-apart openings 76. The flange 74 defines slots 78 open to an exterior edge. The slots 78 align with the holes 22 in the wall 18 of the housing 12. The flange also defines a pair of opposing holes 80. The holes 80 align with the posts 46. A side portion of the cavity 71 defines an opening 82 which is sized for receiving a portion of the lamp socket 56. The flange 74 defines a pair of opposing flats 84. A pad 86 of an insulative material is disposed between the bottom 30 and the reflector 70. The reflector 70, such as a stamped aluminum member, seats on the surface 23 of the wall 18 with the cavity 71 within the housing 12. The openings 76 provide air flow pathways from the cavity 71.

A cap 90 closes the housing 12. The cap 90 defines a central opening 92. Fingers 94 extend from an inner surface of the cap 90 adjacent the central opening 92. The fingers 94 angle towards the opening 92. The fingers 94 cooperatively engage a glass lens 96. In the illustrated embodiment, the glass lens 96 is a UV filter for reducing emissions from halogen light bulbs used with the light fixture 10. A plurality slot-like of openings 98 are defined in the cap 90. A pair of tabs or ears 99 extend radially inwardly from a skirt of the cap 90 on opposing sides.

The lighting fixture 10 described above is particularly useful for recessed mounting in cabinets, as discussed below, with a surface can 100 for surface mounting of the fixture 10. The can 100 defines an annular ring 102 having an inwardly extending flange 104. The flange defines three slots 108. Opposing flanges 109 extend on the interior of the can 100 in alignment with the slots 108. The slots 108 align with the slots 78 in the reflector 70 for a purpose discussed below. Two pairs of side flanges 110, 112 extend on the interior from opposing sides of the ring 102. A plurality of pins 114 extend from the ring 102 opposing the flange 104. The pins 114 space the can 100 from a surface to which the can 100 mounts and defines airflow pathways between the light fixture 10 and the surface. An alternate embodiment does not include the pins 114, but defines a plurality of spaced-apart holes in the ring 102 for airflow out of the can 100. The ring 102 defines an opening 116. A pair of ears 118 extend from opposing portions of the ring 102. The ears 118 define openings 119 for receiving screws to mount the can 100 to a surface.

FIG. 2 is a perspective top view of an alternate embodiment of the housing 12 for the light fixture shown in FIG. 1. In this embodiment, the housing includes opposing tabs 120 which each define a keyed opening 122. The keyed opening includes a hole and a lateral slot for receiving a screw head and shaft for securing the housing 12 to a mounting surface.

FIG. 3 is a perspective bottom view of the housing 12 illustrated in FIG. 2. The housing 12 defines a socket 124 in the side wall and bottom having opposing retaining clips for receiving and engaging a stem (not illustrated) for connecting the housing 12 to an electrical junction box as disclosed in my U.S. Pat. No. 6,431,722.

Figure 5:
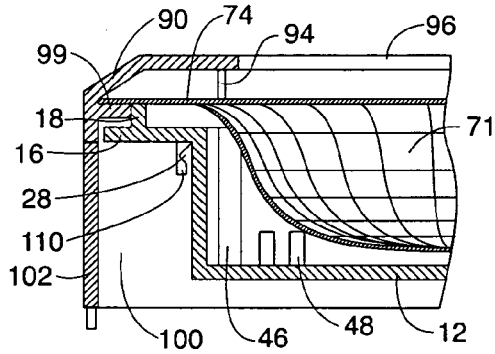
FIG. 5 is a side cut-away view illustrating features of the light fixture shown in FIG. 1.

FIG. 5 is a side cut-away view illustrating features of the light fixture 10 shown in FIG. 1. The reflector 70 seats on the surface 23 of the wall 18. The housing 12 receives the cavity 71. The ear 99 of the cap 90 is received in a gap between the flange 74 of the reflector 70 and the flange 16 of the housing 12. The cap 90 is installed by aligning the ears 99 with the flats 84 of the reflector and rotating the cap 90.

Figure 6:
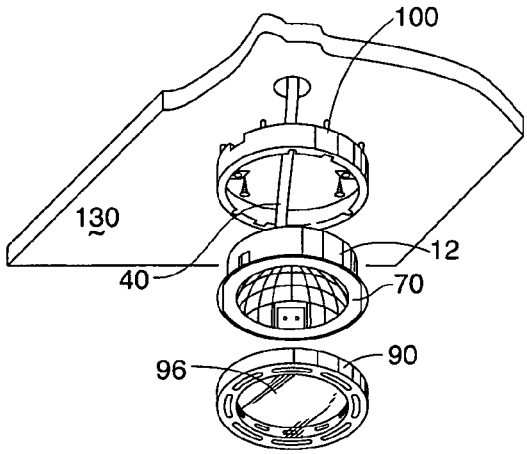
FIG. 6 is a perspective view of a surface-mounting installation of the light fixture shown in FIG. 1.
Figure 7:
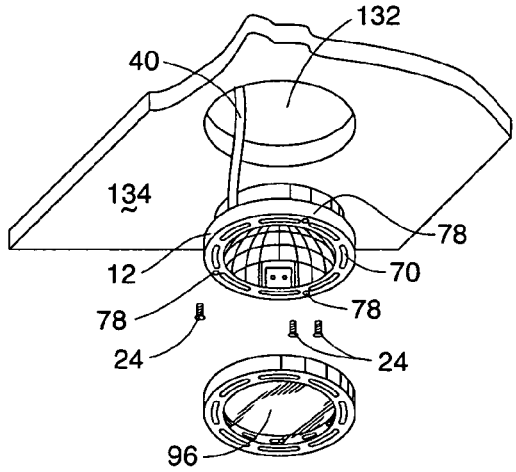
FIG. 7 is a perspective view of a recessed-mounting installation of the light fixture shown in FIG. 1.

FIG. 6 is a perspective view of a surface-mounting installation of the light fixture 10. In this mounting, the can 100 mounts with screws extending through the openings 119 in the ears 118. The can 100 receives the housing 12 that includes the reflector 70. FIG. 7 is a perspective view of a recessed mounting installation of the recessed lighting fixture 10. In this installation, the can 100 is not used. Rather, the housing 12 is secured within a recess 132 in a mounting surface 134 with screws 24 extending through the slots 78 aligned with the openings 22 in the flange 16. In both installations, screws pass through the openings 80 in the reflector 70 and into the posts 46 to attach the reflector to the housing 12. The cap 80 closes the housing 12.

For use, the electric wires 40 pass through the slot 38 in the housing 12 and separate. The separate wires loop through the respective studs 48 adjacent the posts 46 on opposing sides of the housing 12. The distal ends of the electric wires 40 electrically connect to the socket 56 through the opposing side openings 57. The socket 56 is secured in a recess by the tabs 50. Screws extending through the holes in the brace 44 connect to the lugs 42. The brace secures the electric wires 40 in the slot 38.

The insulative pad 86 sits on the thickened central portion 36. The reflector 70 inserts into the housing 12 and seats on the pad 86. Screws extend through the openings 80 and into the posts 46 to attach the reflector 70 to the housing 12. The socket 56 receives the bulb 60.

As illustrated in FIG. 7, the housing 12 may be installed for recess-mounting in the annular recess 132 of the surface 134. An appropriate sized hole or recess is created in the selected location. The electrical wires 40 pass through the recess 132. The recess 132 receives the housing 12. The flange 16 overlaps a portion of the surface 134. The screws 24 extend past the slots 78 and through the openings 20 to engage the surface 134. The heads of the screws 24 seat recessed below the surface 23 of the wall 18 to secure the housing 12 in place. The cap 90 is attached to the distal end of the housing 12. This is accomplished by pushing the ears 99 past the opposing flats 80 and into the gap between the flanges 16 and 74. Rotation of the cap 90 moves the ears 99 along the gap. The stops 26 keep the cap 90 from over-rotation. The electric wires 40 connect to a source of electric current.

The lighting fixture 10 of the present invention also surface mounts as illustrated in FIG. 6 with the housing 12 received within the open end of the can 100. This is accomplished by locating a selected position for the fixture 10 on the mounting surface 130. The electrical wires 40 extend through an opening in the surface 130. The housing 12 connects to the reflector 60 by screws extending through the openings 80 and engaging the posts 46. Screws extending through the openings 119 in the ears 118 attach the can to the surface 130. The can 100 secures to the surface 120 when the heads of the screws 18 are flush with the surface of the ridge 18. The can 100 then receives the housing 12 which is pushed into the can 100. The tabs 28 flex and allow the housing 12 to seat into the can 100. The flanges 110, 112 receive the tabs 28 therebetween to prevent rotation of the housing 12. It is to be appreciated that the light fixture 10 may also be further secured with the screws 24 extending through the aligned slots 78 and openings 20. The electrical wires 40 connect to a source of electrical current for powering the light fixture 10. The pins 114 extending from the ring 102 define airflow pathways between the light fixture 10 and the surface 130. The airflow pathway provides a thermal pathway for communicating heat from the lighting fixture 10. The cap 90 is attached as discussed above.

In operation, the lighting fixture 10 defines thermal pathways through the cap 90, the reflector 70, and the housing 12, for communicating heat from the lighting fixture to ambient air. These pathways provide an air pathway chimney effect for transferring heat from the fixture 10 to ambient air. Air enters the lighting fixture 10 through the slot-like openings 98 in the cap 90. The air travels through the openings 76 in the reflector 70. With the light bulb 60 illuminated, the air becomes heated as it travels past the reflector 70. The heated air exits the housing 12 through the openings 32 in the bottom 30. For recess mounting, the heat communicates into the space above the mounting surface 134. For surface mounting, the heat communicates outwardly of the housing along the surface 130 through the gaps or pathways defined by the pins 114. In an alternate embodiment, the heated air communicates through holes in the side wall of the housing 12 and the can 100.

The present invention accordingly provides an improved puck lighting system for surface and recessed mounting that is installed with a cap that easily connects to the reflector and base and that facilitates flow of heat away from the base through the vents to the ambient air. Accordingly, the present invention provides puck lighting fixtures particularly suited for under-cabinet installations. The principles, preferred embodiments, and modes of operation of the present invention have been described in the foregoing specification. The invention is not to be construed as limited to the particular forms disclosed as these are regarded as illustrative rather than restrictive. Moreover, variations and changes may be made by those skilled in the are without departing from the spirit of the invention described in the following claims.

What is claimed is:

1. An under-cabinet lighting fixture for attaching to a support with fasteners, comprising:

a housing defining an open end that opposes a base, the base defining an opening, and an integral flange extending radially from an exterior surface of a side wall of the housing, the flange spaced-apart longitudinally from a distal edge of the side wall at the open end of the housing;

a reflector defining a dished cavity and at least one opening in the reflector, the reflector seating fixedly with fasteners on the distal edge of side wall of the housing, thereby defining a recess between an edge portion of the reflector and the flange, a perimeter edge of the reflector defining opposed flats radially inwardly of a remaining portion thereof;

means for providing a source of light within the housing; and a cover received on the housing, the cover having a port for communicating light from the source therethrough and an interior tab received past the flats and into the recess, whereby the lighting fixture defines a pathway for communicating air past the reflector for communicating heat from the reflector to ambient air.

2. The under-cabinet lighting fixture as recited in claim 1, wherein the distal edge of the side wall defines at least one recessed opening therein and oriented longitudinally relative to the side wall, whereby a head of a fastener received through the opening is disposed apart from the distal edge of the side wall.

3. The under-cabinet lighting fixture as recited in claim 1, wherein the base has at least a thickened portion.

4. The under-cabinet lighting fixture as recited in claim 3, wherein the lamp bulb substantially aligns with the thickened portion of the base.

5. The under-cabinet light fixture as recited in claim 3, further comprising an insulating pad received within the housing in alignment with the thickened portion.

6. The under-cabinet lighting fixture as recited in claim 1, further comprising an open-ended can for receiving the housing through one end of the can and defining a plurality of pins extending outwardly from an opposing end of the can to define a gap between the can and a surface to which the can is mounted.

7. The under-cabinet light fixture as recited in claim 1, further comprising a recess in a side of the housing for matingly receiving a socket.

8. The under-cabinet light fixture as recited in claim 7, wherein the reflector defines a slot for receiving the socket upon seating the reflector on the open end of the housing, the socket extending through the slot inwardly of the cavity defined by the reflector for receiving the lamp bulb therein.

9. The under-cabinet lighting fixture as recited in claim 1, wherein the cover defines a central opening configured to receive a transparent sheet.

10. The under-cabinet lighting fixture as recited in claim 1, wherein lamp means comprises a socket received in the housing with a lamp bulb engaged to the socket.

11. The under-cabinet lighting fixture as recited in claim 1, further comprising a stop projecting radially from the housing between the flange and the edge, whereby the cover, guided by the tab traveling in the recess, rotates relative to the housing until stopped by the stop.

12. A lighting fixture, comprising:

a housing defining an open end that opposes a base, the base defining an opening, an integral flange extending radially from an exterior surface of a side wall of the housing, the flange spaced-apart from a distal edge of the side wall at the open end of the housing, and the side wall of the housing defining at least one recessed opening extending longitudinally from the distal edge of the side wall, whereby a head of a fastener received through the opening for securing the housing to a support is disposed apart from the distal edge of the side wall;

a reflector defining a dished cavity and at least one opening in the reflector, the reflector fixedly seated with fasteners on the edge of the housing, thereby defining a recess between an edge portion of the reflector and the flange, a perimeter edge of the reflector defining opposed flats radially inwardly of a remaining portion thereof;

a lamp mounted within the housing for emitting light; and a cover received on the housing, the cover having a port for communicating light from the lamp and an interior tab received past the flats and into the recess, whereby the lighting fixture defines a pathway for communicating air past the reflector for communicating heat of the lamp from the reflector to ambient air while the recess secures the cover thereon.

13. The lighting fixture as recited in claim 12, further comprising a stop projecting radially from the housing between the flange and the edge, whereby the cover, guided by the tab traveling in the recess, rotates relative to the housing until stopped by the stop.

14. The lighting fixture as recited in claim 13, wherein the base has at least a thickened portion.

15. The lighting fixture as recited in claim 14, wherein the lamp bulb substantially aligns with the thickened portion of the base.

16. The lighting fixture as recited in claim 14, further comprising an insulating pad received within the housing in alignment with the thickened portion.

17. The lighting fixture as recited in claim 14, further comprising an open-ended can for receiving the housing through one end of the can and means for defining a gap between the can and a surface to which the can is mounted.

18. The lighting fixture as recited in claim 17, wherein means for defining comprises a plurality of pins extending outwardly from an opposing end of the can.

19. The lighting fixture as recited in claim 17, wherein the housing defines a recess in a side of the housing for matingly receiving a socket; and wherein the reflector defines a slot for receiving the socket upon seating the reflector on the open end of the housing, the socket extending through the slot inwardly of the cavity defined by the reflector for receiving a lamp bulb therein.

20. A light fixture, comprising:

a housing defining an open end that opposes a base, the base defining an opening for communication of air therethrough, an integral flange spaced-apart from a distal edge of the side wall at the open end of the housing extends radially from the side wall, the distal edge of the side wall of the housing defining at least one recessed opening oriented longitudinally relative to the side wall, whereby a head of a fastener for securing the housing to a support received through the opening is disposed apart from the distal edge of the side wall, and a stop projecting radially from the housing between the flange and the edge;

a reflector defining a dished cavity and at least one opening in the reflector, the reflector seating with at least one fastener on the edge of the housing, thereby defining a recess between an edge portion of the reflector and the flange, a perimeter edge of the reflector defining opposed flats radially inwardly of a remaining portion thereof;

a lamp mounted within the housing for emitting light; and a cover received on the housing, the cover having a port for communicating light and an interior tab received past the flats and into the recess, whereby the cover, guided by the tab traveling in the recess, rotates relative to the housing until stopped by the stop.

21. The light fixture as recited in claim 20, further comprising an insulating pad received within the housing in alignment with the lamp.

22. The light fixture as recited in claim 21, further comprising an open-ended can for receiving the housing through one end of the can and means for defining a gap between the can and a surface to which the can is mounted.

23. The light fixture as recited in claim 22, wherein means for defining comprises a plurality of pins extending outwardly from an opposing end of the can.

24. An under-cabinet lighting fixture, comprising:

a housing having a base and an opposing open end;

an integral flange spaced-apart from an edge at the open end and extending radially from an exterior surface of the housing;

a reflector defining a dished cavity and seating on the edge of the housing, thereby defining a recess between an edge portion of the reflector and the flange, a perimeter edge of the reflector defining opposed flats radially inwardly of a remaining portion thereof;

threaded fasteners for securing the reflector to the edge of the housing;

means for providing a source of light within the housing; and a light transmissive cover received on the housing and having a pair of tabs received past the flats and into the recess for guiding the roatation of the cover thereon.

25. The under-cabinet lighting fixture as recited in claim 24, further comprising vent means for communicating heated air outwardly of the housing to ambient air.

26. The under-cabinet lighting fixture as recited in claim 25, wherein vent means comprises the cover defining at least one opening, whereby the lighting fixture defines a pathway for communicating heated air from the reflector to ambient air.

27. The under-cabinet lighting fixture as recited in claim 25, wherein vent means comprises the cover, the reflector, and the base each defining at least one opening, whereby the lighting fixture defines a pathway for communicating heated air from the reflector to ambient air.

28. The under-cabinet lighting fixture as recited in claim 25, further comprising an insulating pad received within the housing in alignment with the source of light.

29. The under-cabinet lighting fixture as recited in claim 25, further comprising a stop projecting radially from the housing between the flange and the edge, whereby the cover, guided by the tab traveling in the recess, rotates relative to the housing until stopped by the stop.

* * * * *